US005396717A

United States Patent [19]

Bell

[11] Patent Number: 5,396,717

[45] Date of Patent: Mar. 14, 1995

[54] CONVERTIBLE OVERSHOE WITH TEAR RESISTANT BEAD

[76] Inventor: Michael Bell, 1705 Triumphe Way, Warrington, Pa. 18976

[21] Appl. No.: 226,449

[22] Filed: Apr. 12, 1994

Related U.S. Application Data

[63] Continuation of Ser. No. 80,379, Jun. 21, 1993, abandoned.

[51] Int. Cl.[6] ..... A43B 1/10; A43B 3/26

[52] U.S. Cl. ..... 36/7.3; 36/7.1 R; 36/97

[58] Field of Search ..... 36/7.1 R, 7.3, 7.4, 36/97, 9

[56] References Cited

U.S. PATENT DOCUMENTS

| | | | |
|---|---|---|---|
| 384,097 | 6/1888 | Stout | 36/7.3 |
| 881,153 | 3/1908 | Rickert | 36/7.3 |
| 2,254,685 | 9/1941 | Jackson | 36/7.3 |
| 2,465,911 | 3/1949 | Morgan | 36/72 R |
| 3,026,635 | 3/1962 | Slade | 36/7.3 |
| 4,562,834 | 1/1986 | Bates et al. | 36/7.1 R |
| 4,779,360 | 10/1988 | Bible | 36/7.7 |
| 4,967,491 | 11/1990 | Plotkin | 36/7.1 R |

*Primary Examiner*—Paul T. Sewell
*Assistant Examiner*—Marie Denise Patterson
*Attorney, Agent, or Firm*—Caesar, Rivise, Bernstein, Cohen & Pokotilow, Ltd.

[57] ABSTRACT

An convertible overshoe for disposition on one primary shoe and being convertible for disposition on a larger primary shoe. Each of said primary shoes has an outer surface. The overshoe is formed as an integral unit of an elastic material, e.g., rubber, and comprises a sole and an upper. The sole includes anti-slip grit on its outer surface. The upper is in the form of a peripheral sidewall having an opening at the top edge thereof. The opening is of a sufficient size to enable a primary shoe to be extended therethrough so that it is received closely within the overshoe to prevent the overshoe from falling off. The sidewall of the upper includes a reinforcing strip in the form of a continuous thickened bead extending along a portion of the peripheral edge of the opening and spaced below that edge and an associated contiguous portion defining a trim line. The material of the sidewall at the trim line is readily severable so that it can be severed to remove the sidewall portion of the upper from it to the opening. This action forms an enlarged opening in the upper for a larger primary shoe to be extended through it into to overshoe. The reinforcing bead prevents the overshoe from tearing at the enlarged opening should that opening be stretched when the larger primary shoe is inserted therethrough.

12 Claims, 2 Drawing Sheets

CONVERTIBLE OVERSHOE WITH TEAR RESISTANT BEAD

This application is a continuation of application Ser. No. 08/080,379, filed Jun. 21, 1993, now abandoned.

BACKGROUND OF THE INVENTION

This invention relates generally to footwear, and more particularly to overshoes adapted to be worn over other footwear.

Heretofore rubber overshoes (sometimes referred to as "rubbers" or "galoshes") which are to be worn over other shoes to protect the latter and/or to provide resistance to slipping have been of limited adaptability. In this regard such prior art overshoes have typically been constructed so that they are suitable for use on only one size of shoe (or, perhaps, one or a few slightly larger shoes—if the material forming the overshoe is quite elastic and can stretch sufficiently to accommodate the larger shoe without the overshoe tearing). This limits the usefulness of the overshoe substantially. Thus, a person having several shoes of different sizes or outer dimensions will necessarily have to purchase overshoes for each of those shoes.

In U.S. Pat. No. 2,465,911 (Morgan) there is disclosed a waterproof protector designed to be worn directly on a woman's foot, or over a woman's shoe, or between the shoe and an outer protective overshoe and whose height is adjustable to protect the wearer's hosiery. The protector comprises a closed foot portion forward of the heel, with the heel being open from rearwardly of the ball of the foot to a point above the bulge of the rear portion of a shoe or slipper worn under the protector. The protector terminates in a cylindrical top having plural horizontal tear lines or perforations. The user of the protector can sever the top of the protector along one of the tear lines to establish the height of the top of the protector and thus protect a portion of the wearer's hosiery from the ankle up.

While the shoe protector of the aforementioned patent appears generally suitable for its intended purpose of protecting hosiery, it never the less fails to make up for the aforementioned deficiency of the prior art, i.e., the inability of one size overshoe to accommodate shoes of differing sizes.

OBJECTS OF THE INVENTION

Accordingly, it is a general object of this invention to provide an overshoe which overcomes the disadvantages of the prior art.

It is another object of this invention to provide an overshoe for footwear which can be readily converted to for use on larger sized footwear, without impairing its structural integrity.

It is still another object of this invention to provide an overshoe which is simple in construction, low in cost, and which is adapted to be converted for use on larger sized footwear.

SUMMARY OF THE INVENTION

These and other objects of this invention are achieved by providing a convertible overshoe for disposition on one primary shoe and being convertible for disposition on another, but larger, primary shoe. Each of the primary shoes has an outer surface.

The overshoe comprises a sole and an upper which have an inner surface. The upper portion of the overshoe includes a sidewall formed of an elastic material, e.g., polyvinyl chloride (PVC) or rubber. An opening is provided in the top of the upper sidewall and is formed by a peripheral edge thereof. The opening is of a sufficient size to enable the one primary shoe to be extended therethrough so that the inner surface of the overshoe closely engages the outer surface of the one primary shoe. The sidewall of the upper additionally includes a portion forming a severing or "trim" line and an associated reinforcing strip. The reinforcing strip, e.g., a thickened continuous bead, extends about the peripheral edge of the opening in the upper and is spaced therefrom. The trim line is located between the reinforcing strip and the opening and is immediately adjacent the reinforcing strip.

The material making up the sidewall of the upper at the trim line is readily severable so that it can be cut to remove the portion of the upper from the severing line to the opening, thereby forming an enlarged opening in the upper. The enlarged opening enables the other primary shoe to be extended through it so that the inner surface of the overshoe engages the outer surface of the other primary shoe to hold it in place thereon.

The reinforcing strip prevents the overshoe from tearing at the enlarged opening when the other primary shoe is inserted therethrough.

DESCRIPTION OF THE DRAWINGS

Other objects and many attendant features of this invention will become readily appreciated as the same becomes better understood by reference to the following detailed description when considered in connection with the accompanying drawings wherein.

DETAILED DESCRIPTION OF THE PREFERRED EMBODIMENTS

Figure 1:
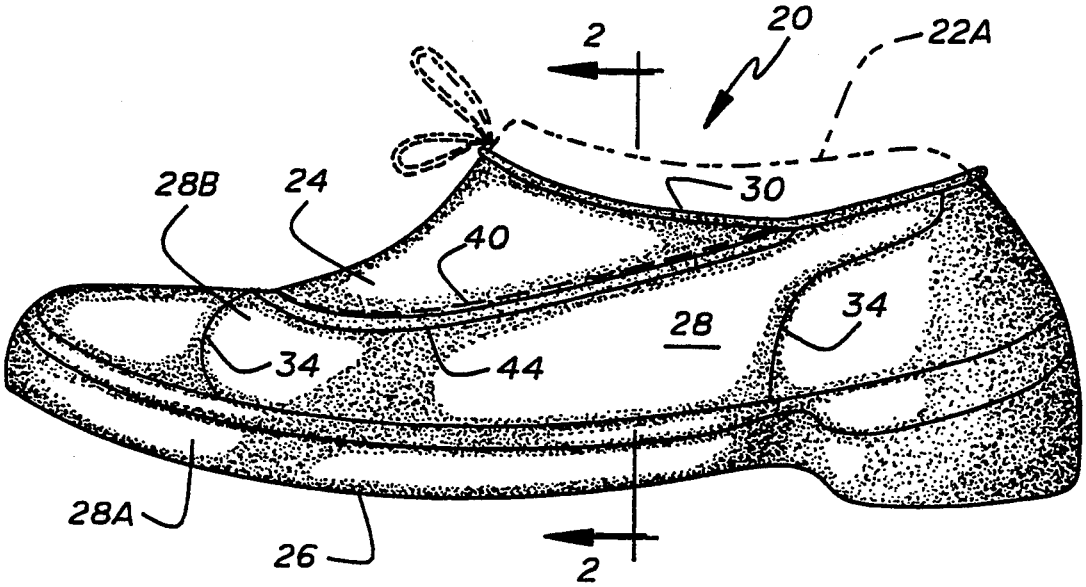
FIG. 1 is a side elevational view of the overshoe of this invention bearing a primary shoe disposed therein.

Referring now to various figures of the drawing where like reference numerals refer to like parts there is shown at 20 in FIG. 1, a convertible overshoe constructed in accordance with this invention. The convertible overshoe 20 is arranged to be used, i.e., worn, on a primary shoe to protect it from water or to provide some other function not provided by the primary shoe, e.g., resistance to slippage. The overshoe 20 is arranged to be readily converted so that it can be worn on another larger primary shoe (e.g., a shoe of a larger size or a shoe of the same size but having a larger exterior) without sacrificing any of the properties it had prior to its conversion, and while maintaining its structural integrity. It must be pointed out at this juncture that the "primary shoe" on which the overshoe of this invention may be worn can be any type of footwear, e.g., a boot, sneaker, athletic shoe, etc. Thus, the term primary shoe as used herein is not to be limited to any particular type of footwear or "shoe."

The overshoe is a hollow member for accommodating the primary shoe therein, and basically comprises an upper 24 and a sole 26. The upper is in the form of a peripheral sidewall 28 extending about the entire periphery of the sole. The top edge 30 of the sidewall forms an opening 32 (FIG. 2) through which the primary shoe 22A is inserted when it is desired to wear the overshoe on that primary shoe.

In accordance with a preferred embodiment of this invention the overshoe 20 is molded as an integral unit of any suitable material, e.g., polyvinyl chloride, although such an integral construction is not required. Thus, the sole and the upper may be formed of separate components, of the same or different materials, which are secured together to form the hollow overshoe. In any case the sidewall 28 of the upper should be formed of an elastic material to enable it to stretch slightly for reasons to be understood later.

Figure 2:
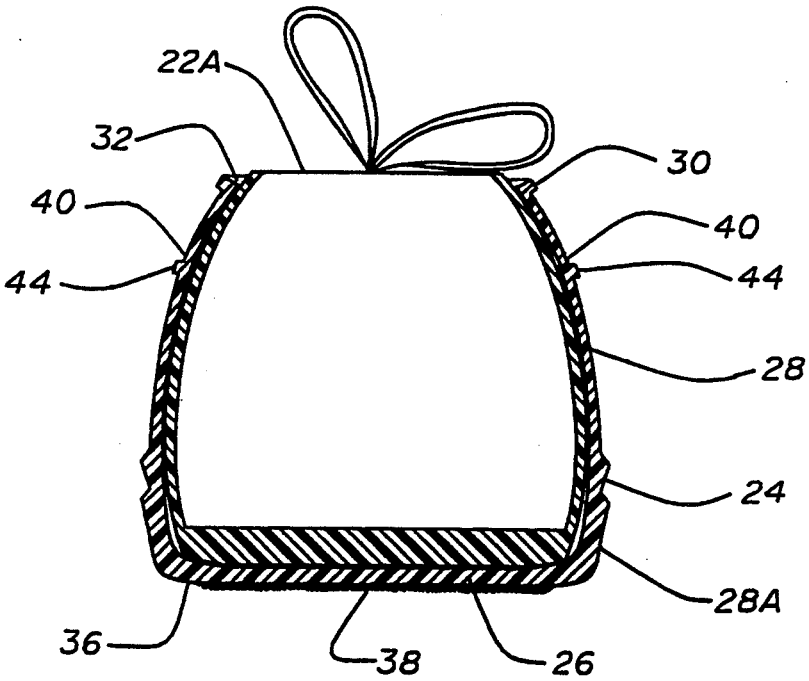
FIG. 2 is an enlarged sectional view taken along line 2—2 of FIG. 1.

As can be seen in FIG. 2 the sidewall includes a lower or "welt" portion 28A contiguous with the sole 26. The material making up the welt portion is of increased thickness as compared to the portion 28B of the sidewall 28 above the welt portion. In particular, in accordance with a preferred embodiment of this invention the sole and the welt portion of the upper sidewall are each of approximately ⅛ inch (3.2 mm) thick, while the upper portion 28B is 1/16 inch (1.6 mm) thick. The increased thickness of the material forming the welt portion and the sole is in the interests of ruggedness and wear resistance.

Figure 4:
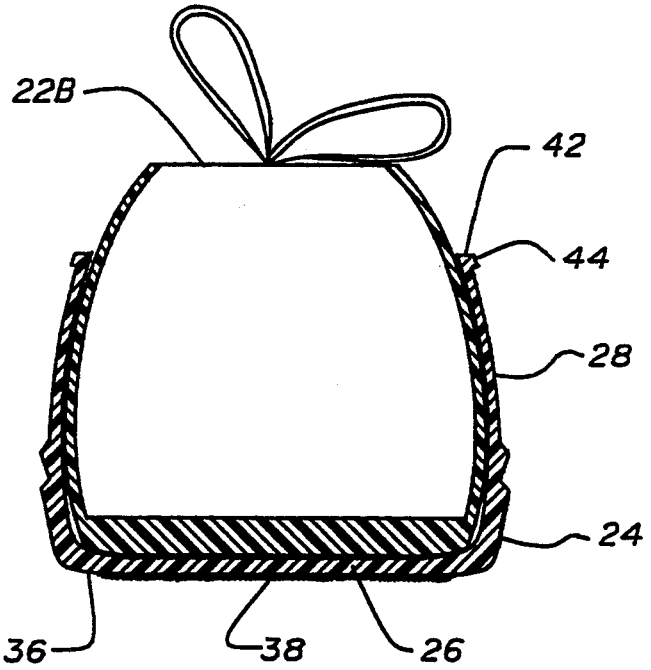
FIG. 4 is an enlarged sectional view taken along line 4—4 of FIG. 3.

The upper 24 may include raised surface decoration or appearance features 34 so that the overshoe provides the same appearance as overshoes of the prior art. The bottom surface of the sole can also be of any shape and/or pattern. In a preferred embodiment of this invention, and as can be seen clearly in FIGS. 2 and 4 the bottom surface 36 of the sole includes hard material, e.g., carbide, grit 38 bonded or otherwise secured to the sole to provide a non-skid walking surface.

Figure 3:
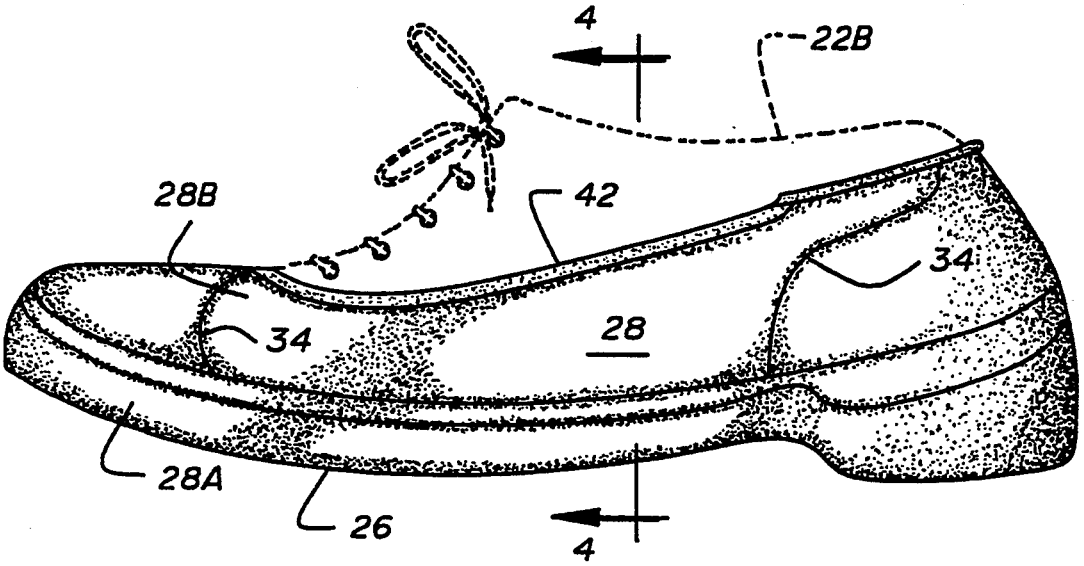
FIG. 3 is a side elevational view like that of FIG. 1, but showing the overshoe trimmed or converted to accommodate a larger primary shoe therein.

In order to enable the overshoe 20 to accommodate a larger primary shoe 22B (FIGS. 3 and 4), the thinner sidewall portion 28B includes a portion forming a severing or trim line 40 (FIG. 1). The trim line 40 extends along the sidewall portion 28B below the peripheral top edge 30 from approximately the location of the ankle bone forward. The upper 28 is arranged to be severed or cut along the trim line 40 to remove the portion of the upper from the trim line to the peripheral edge 30, thereby forming an enlarged opening 42 as shown in FIG. 3. The primary shoe 22B, which is somewhat larger than the primary shoe 22A, can then be inserted into the overshoe 20 through the enlarged opening 42, with the elastic upper material stretching, if necessary, to accommodate the passage of that shoe therethrough.

In order to prevent the sidewall of the upper contiguous with the enlarged opening 42 from tearing when the larger primary shoe 22B is introduced into the overshoe, a reinforcing strip 44 is provided in the sidewall portion 28B adjacent the enlarged opening 42. In particular, the strip 44 is in the form of a continuous bead extending about the upper contiguous with the trim line 40. The bead is formed by increasing the thickness of the sidewall portion 28B at the bead so that it will be approximately the same thickness as the welt portion of the sidewall.

It should be pointed out at this juncture that other reinforcing means can be used in lieu of a thickened bead. Thus, a strip of a strong, somewhat stretchable, yet tear-resistant material (not shown) may be molded in the material making up the sidewall portion 28B along the trim line.

As should be appreciated by those skilled in the art when the sidewall of the upper is severed along the trim line and the portion of that sidewall from the trim line up is removed, the reinforcing strip, e.g., bead, 44 will form the marginal edge of the enlarged opening 42. Since the bead is thicker, e.g., twice as thick, as the material making up the sidewall 28B, the bead will provide substantial resistance to tearing or splitting when the larger primary shoe is introduced into the overshoe if the sidewall of the overshoe has to stretch somewhat to receive that shoe.

In the interests of facilitating the trimming of the upper portion 28B along the trim line 40, the sidewall of the upper at the trim line may be weakened or perforated.

Without further elaboration the foregoing will so fully illustrate my invention that others may, by applying current or future knowledge, adapt the same for use under various conditions of service.

I claim:

1. A convertible overshoe for the protection of and for disposition on one primary shoe and being convertible for the protection of and for disposition on a larger primary shoe, each of said primary shoes having an outer surface, said overshoe comprising a sole, a toe portion, and an upper which have an inner surface, said upper being formed of an elastic material sidewall and comprising an opening formed by a peripheral edge, and a reinforcing strip located along said sidewall, said reinforcing strip meeting said peripheral edge at each side of the shoe and extending obliquely therebelow toward said toe portion, said opening being of a size to enable said one primary shoe to be extended therethrough so that said inner surface of said overshoe engages the outer surface of said one primary shoe, said upper also having a narrow trim line located immediately above and parallel to said reinforcing strip and located between said reinforcing strip and said opening, the material of said sidewall at said trim line being weakened and therefore severable so that it can be severed therealong to remove the portion of said upper from said severed trim line to said opening, thereby forming an enlarged opening in said upper, said enlarged opening enabling said larger primary shoe to be extended through it so that the inner surface of said overshoe engages the outer surface of said other primary shoe, with said reinforcing strip preventing said overshoe from tearing at said enlarged opening.

2. The overshoe of claim 1 wherein said upper and said sole are formed as an integral unit.

3. The overshoe of claim 2 wherein said material forming said sidewall is selected from the group consisting of polyvinyl chloride and rubber.

4. The overshoe of claim 1 wherein said sole of said overshoe includes anti-slip means to prevent the wearer of said overshoe from slipping.

5. The overshoe of claim 4 wherein said anti-slip means comprises grit secured to said sole.

6. The overshoe of claim 2 wherein said sole of said overshoe includes anti-slip means to prevent the wearer of said overshoe from slipping.

7. The overshoe of claim 6 wherein said anti-slip means comprises includes grit secured to said sole.

8. The overshoe of claim 1 wherein said reinforcing strip comprises a continuous bead extending about the entire periphery of said opening, said bead being thicker than the material forming other portions of said sidewall.

9. The overshoe of claim 8 wherein said upper and said sole are formed as an integral unit.

10. The overshoe of claim 9 wherein said material forming said sidewall is selected from the group consisting of polyvinyl chloride and rubber.

11. The overshoe of claim 8 wherein said sole of said overshoe includes anti-slip means to prevent the wearer of said overshoe from slipping.

12. The overshoe of claim 11 wherein said anti-slip means comprises grit secured to said sole.

* * * * *